US005520080A

United States Patent [19]

Sandford

[11] Patent Number: 5,520,080

[45] Date of Patent: May 28, 1996

[54] DIE REGISTRATION AND MOUNTING SYSTEM

[75] Inventor: Peter E. Sandford, London, Canada

[73] Assignee: Die-X Ltd., London, Canada

[21] Appl. No.: 248,315

[22] Filed: May 23, 1994

[51] Int. Cl.[6] ..... B26D 7/26

[52] U.S. Cl. ..... 83/698.510; 83/699.510; 492/31

[58] Field of Search ..... 83/698.71, 699.11, 83/698.51, 699.51; 492/31; 411/338, 339, 401, 402; 36/134, 67 D; 29/525.1

[56] References Cited

U.S. PATENT DOCUMENTS

| | | | |
|---|---|---|---|
| 2,459,610 | 1/1949 | Zadina | 36/67 D |
| 3,752,042 | 8/1973 | Castille | 83/698.51 |
| 3,882,614 | 5/1975 | Albaladejo | 36/67 D |
| 3,982,458 | 9/1976 | Terasaka | 83/699.31 |
| 5,025,576 | 6/1991 | Biasiotto et al. | 36/134 |

*Primary Examiner*—Kenneth E. Peterson
*Attorney, Agent, or Firm*—Phillips, Lytle, Hitchock, Blaine & Huber

[57] ABSTRACT

A novel system for mounting a die on a base is provided. Such a die/die mounting system combination includes a die, the die having a fixed countersunk aperture adjacent one lateral edge thereof, and having a countersunk aperture longitudinally-locatable within a longitudinally-extending slot adjacent an opposite lateral edge thereof. It also includes a pair of indexing nuts, each indexing nut including (i) a nut element provided with a geometrically-shaped head and a depending stub, at least the stub being pierced by an internally-threaded hole, and (ii) an indexing element having an upper externally-threaded shaft, a geometrically-shaped waist and a depending indexing portion, the depending indexing portion including an upper cylindrical end and a lower frusto-conical end. One such indexing nut is secured within the die with the stub of the nut element within the countersunk fixed aperture and with the indexing element firmly threaded into the internally-threaded hole. The other the indexing nut is secured within an accurately-predetermined countersunk aperture which is longitudinally-located along the longitudinally-extending slot, with the stub of the nut element within the longitudinally-located countersunk aperture and with the indexing element firmly threaded into the internally-threaded hole.

8 Claims, 2 Drawing Sheets

DIE REGISTRATION AND MOUNTING SYSTEM

BACKGROUND OF THE INVENTION (i) Field of the Invention

This invention relates to a die registration system.

(ii) Description of the Prior Art

The dies with which the present invention is principally concerned are rotary dies of all sizes for the processing of corrugated board from E flute to double wall. Such dies are computer designed and generated.

A rotary die generally consists of a wood base having a series of slots cut therethrough into which cutting steel strips are inserted. Thereafter, the tool is attached to a rotating press and is used in the manufacture of paper products, e.g., boxes, cartons, etc.

In the past, the die, or a part thereof, in cases where a complete die consist of several adjacent parts, was mounted with reference to a key eye arrangement at the centre and bottom of the die. A reference bolt was provided on a steel roller blank. Thereafter, various circular holes in the die were aligned with a pre-arranged pattern of holes on the steel roller blank of the rotary press to secure the die to the steel roller blank. The pre-arranged hole pattern could be any pattern. In the past, however, it usually consisted of drilled holes spaced about two inches apart in both the linear (axial) direction and along the circumference of the steel roller blank. In mounting the die, the datums or reference points were picked off the key eye which established the mounting datums.

It was found, however, that, in the mounting of the die, a problem of skewing occurred. In other words, the die moved slightly along the base upon which it was mounted. Any skewing compounded the error the further removed a point was from the key eye datums reference point.

SUMMARY OF THE INVENTION (i) Aims of the Invention

Accordingly, the main object of this invention is to provide an improved mounting and indexing or referencing system in mounting a rotary die to the circular steel rolling blank which functions as the roller of the rotating press. Thus, the present invention aims to mount a die properly in a steel roller blank.

(ii) Statements of Invention

It has been found that the solution to such problem is to mount and reference the die longitudinally or axially along the surface of the steel roller blank.

By the present invention the combination is provided of a die and a die mounting system. The combination includes firstly, a die, the die having a fixed countersunk aperture adjacent one lateral edge thereof, and having a longitudinally-extending slot adjacent an opposite lateral edge thereof. Secondly, it includes a pair of indexing nuts, each indexing nut including (i) a nut element provided with a geometrically-shaped head and a depending stub, at least the stub being pierced by an internally-threaded hole, and (ii) an associated indexing element having an upper externally-threaded shaft, a geometrically-shaped waist and a depending indexing portion, the depending indexing portion including an upper cylindrical end and a lower frusto-conical end. In the combination, one indexing nut is secured within the die, with the stub of the nut element within the countersunk fixed aperture and with the indexing element firmly threaded into the internally-threaded hole. The other indexing nut is secured an accurately-predetermined position which is located in the longitudinally-extending countersunk slot, the associated indexing element of the other indexing nut being firmly threaded into the other of the internally-threaded holes.

The present invention also provides the combination of (I) a rotary blank or roller blank provided with a plurality of axially and circumferentially-arranged, spaced-apart referencing datum apertures and a plurality of axially and circumferentially-arranged, spaced-apart internally-threaded securing ports, and (II) a plurality of die and die mounting system combinations as previously described, which are secured in abutting relationship onto the rotary blank or roller blank. Thus, each die and die mounting combination includes firstly, a die, the die having a fixed countersunk aperture adjacent one lateral edge thereof, and having a longitudinally-extending slot adjacent an opposite lateral edge thereof. Secondly, it includes a pair of indexing nuts, each indexing nut including (i) a nut element provided with a geometrically-shaped head and a depending stub, at least the stub being pierced by an internally-threaded hole, and (ii) an associated indexing element having an-upper externally-threaded shaft, a geometrically-shaped waist and a depending indexing portion, the depending indexing portion including an upper cylindrical end and a lower frusto-conical end. In the combination, one indexing nut is secured within the die, with the stub of the nut element within the countersunk fixed aperture and with the indexing element firmly threaded into the internally-threaded hole. The other indexing nut is secured an accurately-predetermined position which is located in the longitudinally-extending countersunk, slot, the associated indexing element of the other indexing nut being firmly threaded into the other of the internally-threaded holes.

(iii) Other Features of the Invention

By one feature thereof, each geometrically-shaped head is hexagonal.

By yet another feature thereof, each fixed aperture and longitudinal slot is provided with a through slit fitted with a stop member, the stop member being adapted to engage the geometrically-shaped head of an associated such indexing element to fix that associated indexing element at a specific position to assist in securing the indexing nut to the die.

By yet another feature thereof, the fixed countersunk aperture in the die is at the right hand side, and the longitudinal slot in the die is at the left hand side.

By one feature thereof, additional fixed countersunk apertures are provided in the die for aiding in the accurate placement of the die on the rotary blank.

By another feature thereof, adjacent dies are joined at abutting edges by bowtie tenons projecting into adjacent abutting edges and dovetail mortises secured into the bowtie tenons.

By one feature thereof, each geometrically-shaped head is hexagonal.

(iv) Further Description of Features of the Invention

A further embodiment of the invention is to provide additional pre-drilled reference holes in the die. If there is no integrity to a particular drilled hole in the mounting drum in any one location, another pre-drilled reference hole may be used.

These rollers in the system are registered to one another and the die roller is registered to the printer. Accordingly, the exact registration and datums mounting is absolutely critical given the cutting speeds in actual manufacture.

The die itself is subject to flex and other variations as a result of temperature. The slot in the left also helps control and provide for these factors.

In cutting the die, the laser is always exact and all dimensions are calculated with respect to the mathematical location of the laser. Accordingly, any problems with dimensioning or temperature flex, etc., have to be ultimately accounted for. Mounting as described, splits any error created by the laser as discussed.

The die itself used in the present invention includes a reference hole and slot. A longitudinal slit is also cut immediately below the slot into which will be pushed a piece of steel. This piece of steel will act as an anvil to ensure that the mounting screw arrangement can be tightened in the slot (or hole.)

A related invention relates to joining adjacent dies and portions of dies together. This is done by means of a bowtie tenon in combination with dovetail mortise in the die. With a laser, the cuts may be precise and so all of the compound angles (i.e., the complexities associated therewith) basically disappear. Thus an excellent joint is provided.

BRIEF DESCRIPTION OF THE DRAWINGS

In the accompanying drawings.

Figure 1:
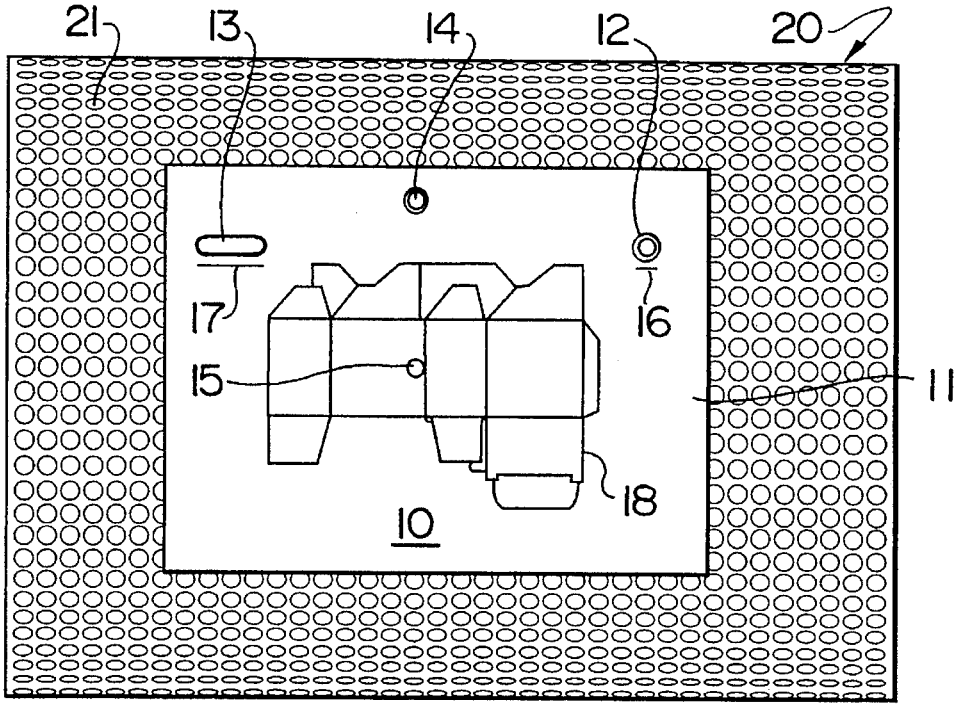
FIG. 1 is a plan view of a die mounting system of one embodiment of the present invention for mounting on a mounting drum, with only one such die combination being shown.
Figure 2:
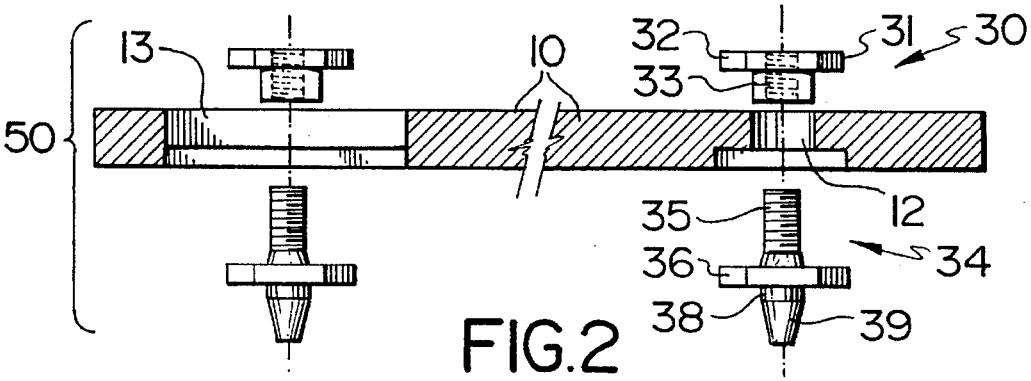
FIG. 2 is a longitudinal section in partially-exploded form showing the means for providing the die and die mounting system combination.
Figure 3:
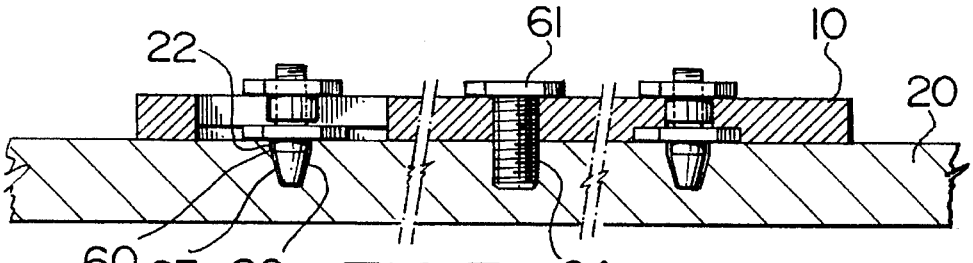
FIG. 3 is a longitudinal section similar to FIG. 2 but with the die mounting system of this invention mounted on a mounting drum.

DESCRIPTION OF PREFERRED EMBODIMENTS (i) Description of FIGS. 1, 2, and 3

As seen in the drawings, and particularly in FIG. 1, the die 10 is a generally rectangular piece of plywood 11 provided with fixed countersunk aperture 12, a slot 13, and a pair of mounting holes 14, 15.

The die 10 is also provided with a slit 16 below and adjacent aperture 12, and a slit 17 below and adjacent slot 13. Aperture 12 is provided in the right hand side of the die 10, while slot 13 is provided in the left hand side of the die. The die 10 is also provided with a plurality of accurately-positioned slits 18 into which steel blades (not shown) are secured to provide the cutting blades of the die 10.

The mounting drum 20 is provided with a plurality of longitudinally- and laterally-spaced-apart indexing apertures 21 for each die 10. As seen more clearly in FIG. 3, each mounting aperture 21 includes an upper, cylindrical portion 22 and a lower frusto-conical portion 23. The mounting drum 20 is also provided with a plurality of internally-threaded mounting ports 24.

(ii) Description of FIGS. 2 and 3

As seen in FIG. 2, the indexing nuts 30, of another embodiment this invention, are shown in exploded relationship to the die 10 prior to being assembled to provide the die/die mounting system 50 of yet another embodiment of this invention as shown in FIG. 3. The indexing nut 30 includes an upper portion 31 constituted by an upper hexagonal nut 32, and a lower stub 33 provided with internal threads 33.

The indexing nut 30 also includes an indexing lower portion 34 constituted by an upper externally-threaded shaft 35, is mid-hexagonal nut 36 and a lower indexing member in the form of an upper cylindrical portion 38 and a lower frusto-conical end 39.

To form the die/die mounting system 50 of this invention, the upper portion 31 of the indexing nut 30 is inserted with its stub 33 within the countersunk portion of aperture 12 of the die 10. The lower portion 34 is then secured by means of insertion of the threaded shift 35 into the internally-threaded stub 33. Firm tightening is aided by the insertion of a steel strip (not shown) into slit 16 to provide an anvil or stop to prevent relative movement between hexagonal nut portions 33 and 36 (with respect to aperture 12).

The indexing nut 30 is then secured in the same manner to a very accurately predetermined position within the slot 13. The accurate positioning is achieved by lateral sliding of the upper portion 31. The upper portion 31 is inserted first into the slot 13 and, following its lateral shift, is secured to a lower portion 34 in the same manner as previously described.

Accordingly, the lower portion 39 of the indexing nuts are fixedly spaced-apart an accurate distance which is defined by the distance between indexing apertures 21.

As seen in FIG. 3, the die/die mounting system 50 is placed on the drum 20 with the lower portion member 39 disposed within the frusto-conical indexing wells 60 forming part of the indexing apertures 21 in the drum 20. The die/die mounting system 50 is then secured to the drum 20 by means of bolts 61 passing through holes 14,15 in the die 10. The bolts are secured within internally-threaded ports 24 in the drum 20.

Figure 4:
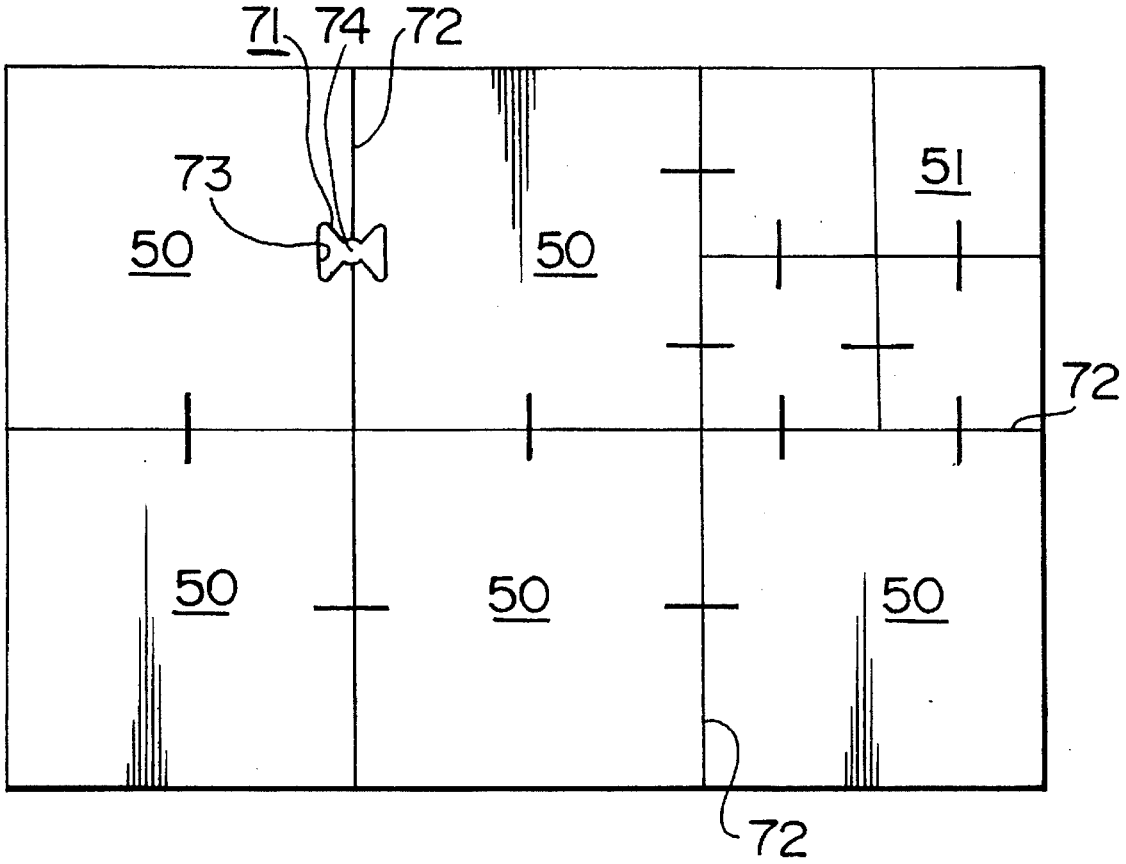
FIG. 4 is a schematic representation of the assembly of portions of the base into a base for the die mounting system of this invention.

(ii) Description of FIG. 4

Another embodiment of the invention is shown in highly diagrammatic form in FIG. 4. Here, the base 10 of the die/die mounting system 50 is formed of multiple components held together by a joinery system 71 at lateral edges 72 to join members 51. In addition, each die/die mounting system 50 is joined to each adjacent such system 50 by the joinery system 71. Such joinery system 71 includes a tenon 73 accurately formed within the side edge 72 and a bow-tie-shaped mortise 74. The mortise 74 is inserted into the adjacent tenons 73 for accurately holding the adjacent components together. In this drawing, only one tenon 73/mortise 74 is shown. The others are shown as line traversing edge 72.

As previously stated, this joinery system 71 may also be used to provide individual dies as shown by die component 51.

DESCRIPTION OF OPERATION OF THE INVENTION

In more general terms, in one embodiment of the invention, a pre-drilled countersunk aperture hole is provided in the right hand side of the die, into which the upper portion of the indexing nut is inserted. The nut portion of the screw has a bushing at the bottom thereof which is adapted to fit into the countersunk portion. The lower portion of the indexing nut includes an upper threaded shaft, a mid-hexagonal portion and a lower tapering member. The uppermost portion of such tapering member is not tapered for a predetermined amount, e.g., about 0.100 of an inch. The tapering member therefore will seat itself within a hole in the base, i.e., the mounting drum. The hole in the mounting drum is itself tapered at its upper-most portion. Consequently, the tapering member is adapted to engage the complementary portion of the hole.

Once the indexing element is mounted to the die on the right hand side, the left hand side is then referenced and aligned. This is done by means of the longitudinal slot cut into the die, into which another indexing element as previously described, is inserted and, if necessary, is laterally slid. This permits any dimensional error to be corrected and the die ultimately is thus provided with two accurate tapering members for mounting on the mounting drum. The actual physical securement of the die to the mounting drum is by means of bolts passing through the die and into pre-drilled, internally-threaded ports in the mounting drum. By this time, the die is properly referenced on the mounting drum.

It can also be seen that the die may thus be removed for repair or maintenance and replaced in the same identical position onto the drum, each and every time.

Advantages of this aspect of the present invention include the following: Expensive plywood material can be sawed and recycled by joining scrap pieces and using them to make dies. The integrity of the joined piece will be the same as the integrity of original piece.

Parts of a die can be joined to improve the conventional technique of simply hammering a corrugated metal. The limitations of this prior art techniques are reasonably obvious, particularly considering the problem of taking off and replacing a die.

The joint will permit dies to be taken apart and will give great flexibility on the shop floor. In practice, it will simply be tacked in with some glue. However, a hammer blow will knock it apart.

In one embodiment of this aspect of the invention, the laser tool will cut the female dovetail portions on the die and will also separately cut the bow ties which have to be dimensioned with reference to the cut hole.

As well all kinds of shapes and sizes can probably be used so long as they are reasonable and fit for the purpose.

Other dies with which the present invention is concerned include the following:

Conventional jig dies which may be used for test dies, short runs, displays, etc. Block dies, which are very accurate modular dies that can be reassembled and reknifed many times. Laser dies which are of top quality and precision and which may be used for the production of pharmaceutical, cosmetics and food cartons. Laser dies produce identical blanks, ensuring higher run speeds, less make ready and trouble free runs on auto platens, gluers and packaging lines. Such dies include permaplex dies, which are the ultimate laser die for dimensional stability. These dies are made of top quality material to sustain extreme accuracy and precision throughout long runs and many reknives. Acrylic glass dies, which are used for special or unusual contoured labels. The dies are made to kiss-cut without cutting back liner. The dies may also be flat dies mounted on a flat bed.

CONCLUSION

From the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably, and "intended" to be, within the full range of equivalence of the following claims.

I claim:

1. In combination, a die and a die mounting system, said combination comprising:

A) a die, said die having a fixed countersunk aperture adjacent one lateral edge, of said die and having a longitudinally-extending countersunk slot adjacent an opposite lateral edge of said die; and B) a pair of indexing nuts, each said indexing nut including (i) a nut element provided with a geometrically-shaped head and a depending stub, at least said stub being pierced by an internally-threaded hole, and (ii) an associated indexing element having an upper externally-threaded shaft, a geometrically-shaped waist and a depending indexing portion, said depending indexing portion including an upper cylindrical end and a lower frusto-conical end;

wherein an associated indexing element of one said indexing nut is secured within said die with said stub of said nut element within said countersunk fixed aperture, and with its associated said indexing element firmly threaded into one of said internally-threaded holes; and wherein an associated indexing element of the other said indexing nut is secured within an accurately-predetermined countersunk aperture position which is located in said longitudinally-extending countersunk slot, the associated indexing element of said other indexing nut being firmly threaded into the other of said internally-threaded holes.

2. The combination of claim 1 wherein each geometrically-shaped head is hexagonal.

3. The combination of claim 1 wherein each said fixed aperture and said longitudinal slot is provided with a through slit fitted with a stop member, said stop member being adapted to engage said geometrically-shaped waist of an associated said indexing element to fix said associated indexing element at a specific position to assist in securing said indexing nut to said die.

4. The combination of:

(I) a rotary blank provided with a plurality of axially and longitudinally-arranged, spaced-apart referencing datum apertures and a plurality of axially and longitudinally-arranged, spaced-apart internally-threaded securing ports; and (II) a plurality of die/die mounting system combinations secured to said blank, each said die/die mounting system combination comprising:

A) a die, said die having a fixed countersunk aperture adjacent one lateral edge of said die and having a longitudinally-extending countersunk slot adjacent an opposite lateral edge of said die; and B) a pair of indexing nuts, each said indexing nut including (i) a nut element provided with a geometrically-shaped head and a depending stub, at least said stub being pierced by an internally-threaded hole, and (ii) an associated indexing element having an upper externally-threaded shaft, a geometrically-shaped waist and a depending indexing portion, said depending indexing portion including an upper cylindrical end and a lower frusto-conical end;

wherein an associated indexing element of one said indexing nut is secured within said die with said stub of said nut element within said countersunk fixed aperture, and with its associated said indexing element firmly threaded into one of said internally-threaded holes; and wherein an associated indexing element of the other said indexing nut is secured within an accurately-predetermined countersunk aperture position which is located in said longitudinally-extending countersunk slot, the associated indexing element of said other indexing nut being firmly threaded into the other of said internally-threaded holes.

5. The combination of claim 4 wherein additional fixed countersunk apertures are provided in said rotary blank for aiding in the accurate placement of said die on said rotary blank.

6. The combination of claim 4 wherein said rotary blank is a rotary drum.

7. The combination of claim 4 wherein adjacent dies are joined at abutting edges by bowtie tenons projecting into adjacent abutting edges and by dovetail mortises secured into said bowtie tenons.

8. The combination of claim 7 wherein individual dies are provided by having components of a base of the die being joined at abutting edges by bowtie tenons projecting into adjacent abutting edges and by dovetail mortises secured into said bowtie tenons.

* * * * *